US007073763B1

(12) United States Patent
Trout

(10) Patent No.: US 7,073,763 B1
(45) Date of Patent: Jul. 11, 2006

(54) SUPPORT ROD FOR STABILIZING AN EXISTING SCISSOR JACK

(76) Inventor: Kenneth R. Trout, 460 Arnos St. #2, Talent, OR (US) 97540

( * ) Notice: Subject to any disclaimer, the term of this patent is extended or adjusted under 35 U.S.C. 154(b) by 60 days.

(21) Appl. No.: 10/940,016

(22) Filed: Sep. 14, 2004

(51) Int. Cl.
*A47F 5/00* (2006.01)

(52) U.S. Cl. ..... 248/352; 248/188.8; 254/126

(58) Field of Classification Search ..... 248/188, 248/188.8, 188.9, 188.91, 677, 200.1; 254/126, 254/122; 280/245, 763.1
See application file for complete search history.

(56) References Cited

U.S. PATENT DOCUMENTS

| | | | | |
|---|---|---|---|---|
| 1,576,721 | A | 3/1926 | Conrad | |
| 1,926,610 | A | 9/1933 | Berglund | |
| 1,954,558 | A | 4/1934 | Conrad | |
| 2,071,470 | A | 2/1937 | Marlowe | |
| 2,467,657 | A | 4/1949 | Brown | |
| 2,508,934 | A | 5/1950 | Berg | |
| 2,667,328 | A | 1/1954 | White | |
| 3,210,048 | A | 10/1965 | Redman | |
| 4,268,066 | A * | 5/1981 | Davis | 280/763.1 |
| 4,765,595 | A | 8/1988 | Alten | |
| 5,575,492 | A * | 11/1996 | Stone | 280/475 |
| 6,851,652 | B1 * | 2/2005 | Huang | 248/200.1 |
| 2004/0194418 | A1 * | 10/2004 | Gouley | 52/720.1 |
| 2005/0109898 | A1 * | 5/2005 | Hsieh | 248/188.9 |

* cited by examiner

*Primary Examiner*—Ramon O Ramirez

(57) ABSTRACT

A support rod that is engageable with the bottom surface of an existing scissor jack. The rod includes an adjustable top portion selectively movable between raised and lowered positions. An elongated and portable support rod is removably engageable with the jack. The rod is provided with axially opposed end portions wherein one end portion has a bored surface for contacting the jack and another end portion is supported on the ground surface. The rod further includes a leg portion removably securable to another coupling that includes a compression-type fitting for adjusting a length of the rod. The leg portion further includes a shoe pivotally attached to a lower end portion thereof and for assisting to maintain the rod at a substantially stable position. A second rod should be symmetrically positioned opposite the first rod and against a second scissor jack on the opposite side of the vehicle, for providing necessary support.

9 Claims, 1 Drawing Sheet

SUPPORT ROD FOR STABILIZING AN EXISTING SCISSOR JACK

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to jack supporting devices and, more particularly, to a support rod for stabilizing a scissor jack employed by $5^{th}$ wheel and travel trailers.

2. Prior Art

Recreational vehicles and trailers typically incorporate spring suspension systems mounted between the chassis frame and the wheels to provide a smooth ride during transit. While such suspension systems enhance passenger comfort and minimize vibration, they often detract from the stability of the passenger compartment when the vehicle is parked. For example, when passengers move about the compartment, the vehicle tends to rock both fore and aft as well as from side to side. Furthermore, this rocking motion is enhanced due to the inherent flexibility of the wheels and slight rolling thereof in response to forward and rearward weight shifting within the vehicle cabin. The industry has addressed such vehicle stability concerns by developing various stabilizer jack devices and systems for use with the vehicles when stationary or parked.

Difficulties with conventional stabilizer jack devices proposed heretofore have been encountered in installed applications where the lateral flanges of the mounting channel and strut would spread laterally outwardly allowing the drive screw and strut to become racked and unbalanced in loading. This spreading of the upwardly turned flanges of the strut results in failure when the flanges slip off of the axle tabs.

In an effort to provide additional longitudinal restraint, other stabilizer devices provide a transverse frame member attached to the outer end of the jack housing and include angular extending support members attached between the lateral outer extremities of the transverse frame member and the jack assembly. Although these angular support members increase longitudinal stability, the additional components increase manufacturing costs, assembly time and complexity.

Accordingly, a need remains for a support that provides stabilizing support to a scissor jack employed by a stationary vehicle, such as $5^{th}$ wheel and traveling trailers. The present invention satisfies such a need by providing a support rod for stabilizing a scissor jack mounted beneath the vehicle. Such a support rod is durable, reliable and has a minimum number of components, reducing manufacturing and maintenance costs. The support rod provides added stability, improving safety and functionality of the vehicle.

BRIEF SUMMARY OF THE INVENTION

In view of the foregoing background, it is therefore an object of the present invention to provide an apparatus for stabilizing $5^{th}$ wheel and traveling trailers. These and other objects, features, and advantages of the invention are provided by a rod for supporting a scissor jack commonly used to stabilize $5^{th}$ wheel and traveling trailers during non-operating conditions. It should be noted that the present invention can be adapted to support various sized scissors jacks commonly employed for exerting pressure and supporting a selected end portion of $5^{th}$ wheel and traveling trailers a short distance above a ground surface.

The present invention includes an elongated, portable rod and is adjustable to a corresponding length of the jack. The support rod is removably engageable with the jack wherein the rod is positioned along a longitudinal axis for reinforcing the jack along its line of weakness. The rod provides an upwardly extending force that opposes operating forces exerting downwardly along the upper arms of the jack. The rod is further provided with axially opposed end portions wherein one end portion has a substantially bored surface for securing to the jack and another end portion is supported on the ground surface.

The rod preferably includes a cylindrical body having a substantially smooth outer surface and a hollow core. The body is preferably formed from rigid and non-corrosive material and further has opposed end portions axially aligned along a linear plane. The rod may further include a pair of couplings removably positionable over the body end portions wherein one coupling has an open top surface and another coupling has open top and bottom surfaces respectively and is disposed distally from the one coupling.

The rod further includes a leg portion removably securable to the other coupling and preferably includes a compression-type fitting positioned thereabout, as well known to a person of ordinary skill in the art. Such a fitting is threadably screwed onto the coupling and can be loosened by hand to adjust the length of the rod, and then tightened to maintain the desired length.

The leg portion further includes a shoe pivotally attached to a lower end portion thereof for assisting to maintain the rod at a substantially stable position. The shoe is preferably provided with a plurality of protrusions selectively spaced along a bottom surface thereof for adequately gripping the ground level during operating conditions.

For necessary support, a second rod should be symmetrically positioned opposite the first rod and against a second scissor jack at the opposite side of the vehicle. Such a second rod is sized and shaped for opposing operating forces directed along an associated line of weakness offset from the vertical axis. The first rod cooperates with the second rod and further assists to maintain the scissor jack at a balanced position to prevent lateral movement thereof.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
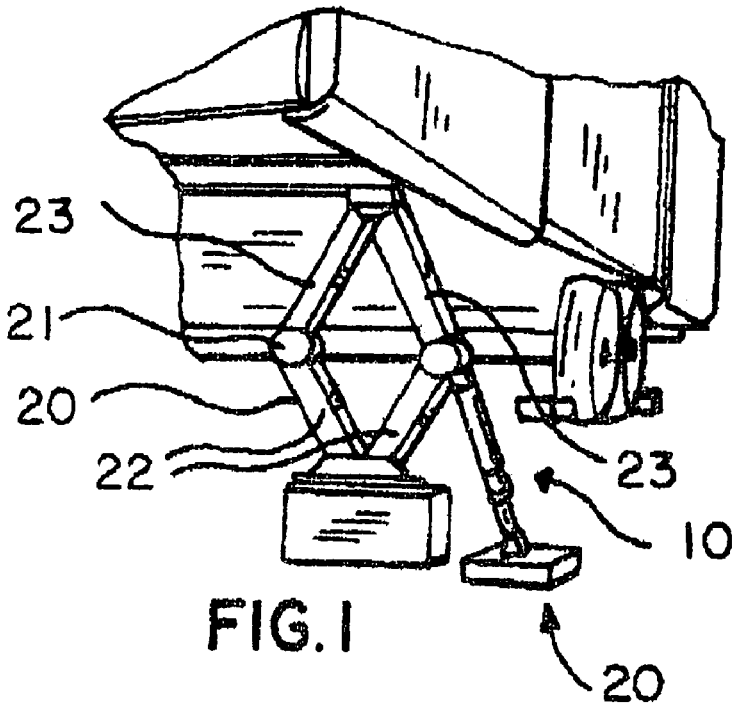
FIG. 1 is a perspective view showing an apparatus for stabilizing a stationary vehicle in a preferred environment, in accordance with the present invention.
Figure 2:
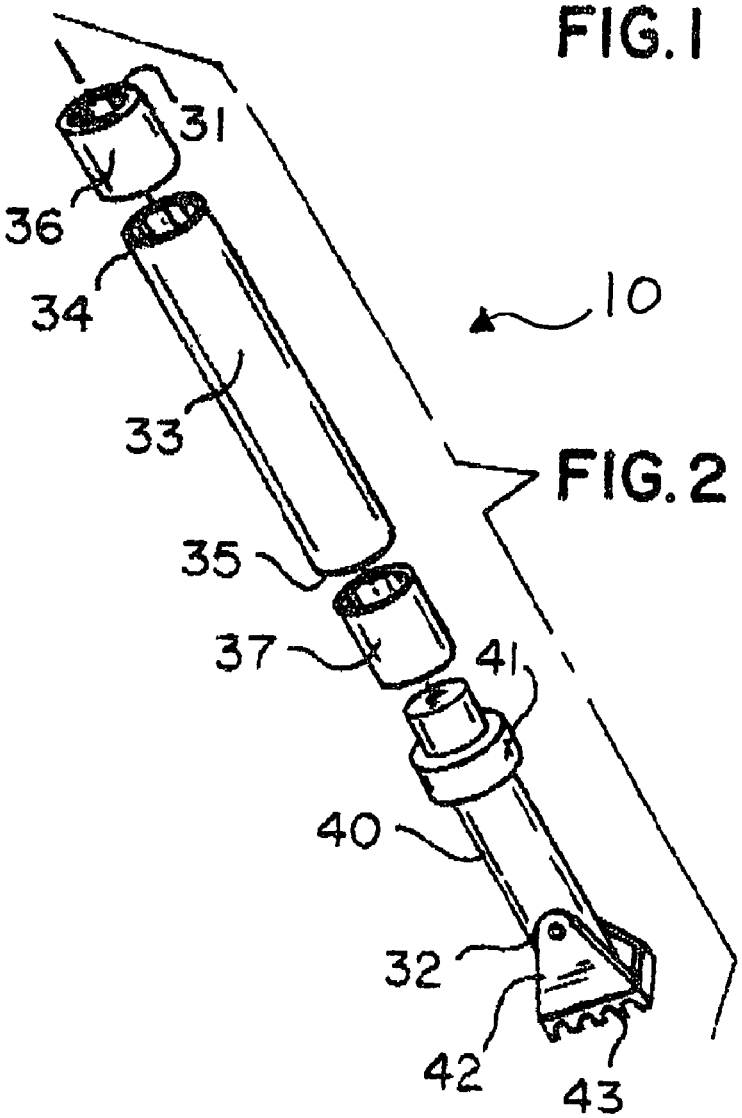
FIG. 2 is an enlarged exploded view of the stabilizing rod shown in FIG. 1.

The apparatus of this invention is referred to generally in FIGS. 1–2 by the reference numeral 10 and is intended to provide a support rod 10 for stabilizing a conventional scissor jack 20. It should be understood that the support rod 10 is not intended to lift the full weight of any RV or similar vehicle. Its use is only to support the existing scissor jack 20 to eliminate the inherent side-to-side movement thereof during operating conditions.

Initially referring to FIG. 1, the present invention includes an elongated, portable rod 10 that is adjustable to the corresponding length of the jack 20. The support rod 10 is removably engageable with the jack 20 wherein the rod 10 is positioned along one of the longitudinal axes for reinforcing the jack 20 along its line of weakness. It is well known in the industry that a conventional scissor jack 20 provides a compact, yet powerful lifting mechanism capable of raising heavy vehicles, such as $5^{th}$ wheels and traveling trailers, for example. In particular, conventional scissor jacks 20 include a top portion 21 provided with a plurality of pivotally attached movable arms 22, 23 wherein upper ones 23 of the arms have longitudinal axes equidistantly and oppositely offset from a vertical axis for defining a line of weakness therealong.

To strengthen such a line of weakness, the rod 10 of the present invention provides an upwardly extending force that opposes operating forces exerting downwardly along the upper arms of the jack 20. The rod 10 is further provided with axially opposed end portions 31, 32 wherein one end portion 31 has a bored surface for connecting to the jack 20 and another end portion 32 for engaging the ground level.

The rod 10 preferably includes a cylindrical body 33 having a substantially smooth outer surface and a hollow core. The body 33 is preferably formed from rigid and non-corrosive material and further has opposed end portions 34, 35 axially aligned along a linear plane. The rod 10 may further include a pair of couplings removably positionable over the body end portions 34, 35 wherein one coupling 36 has an open top surface and another coupling 37 has open top and bottom surfaces respectively disposed distally of the one coupling 36.

The rod 10 further includes a leg portion 40 removably securable to the other coupling 37 that preferably includes a compression-type fitting 41 positioned thereabout. Such a fitting 41 is threadably screwed onto the coupling 37 and can be loosened by hand to adjust the length of the rod 10, and then tightened to maintain the desired length. Fitting 41 provides a quick and simple mechanism by which a user may adapt the rod 10 between extended and retracted positions, as well known to a person of ordinary skill in the art.

The leg portion 40 further includes a shoe 42 pivotally attached to a lower end portion thereof for assisting to maintain the rod 30 at a substantially stable position. The shoe 42 is preferably provided with a plurality of protrusions 43 selectively spaced along a bottom surface thereof for adequately gripping the ground level during operating conditions. The protrusions 43 help prevent slippage of the rod 10 and further increase the stability of the vehicle in the event of lateral movement. This prevents the rod 10 from collapsing to a position where it would provide no support to the scissor jack 20.

For necessary support, a second rod should be symmetrically positioned opposite the first rod 10 and against a second scissor jack on an opposite side of the vehicle. Such a second rod is sized and shaped for opposing operating forces directed along an associated line of weakness offset from the vertical axis. The first rod 10 cooperates with the second rod and further assists to maintain the scissor jack at a balanced position to prevent lateral movement thereof.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and desired by Letters Patent of the United States is:

1. An adjustable support rod for stabilizing an existing scissor jack's line of weakness wherein the jack lifts a selected vehicle end portion a short distance above ground level, said support rod comprising:

an elongated support rod removably connectable with the jack wherein said rod is positioned along a longitudinal axis for reinforcing the jack along the line of weakness, said rod providing an upwardly extending force that opposes operating forces exerting downwardly along the jack and being provided with axially opposed end portions wherein one said end portion contacts the jack and another said end portion is supported on ground level;

wherein said rod further comprises a cylindrical body having a substantially smooth outer surface and a hollow core, said body being formed from rigid and non-corrosive material and further having opposed end portions axially aligned along a linear plane; and a pair of couplings removably positionable over said body end portions wherein one said couplings has an open top surface and another said couplings has open top and bottom surfaces respectively, said another coupling being disposed distally of said one coupling.

2. The support rod of claim 1, wherein said rod further comprises:

a leg portion removably securable to said another coupling and including an adjustable compression fitting threadably securable to said one coupling for assisting a user to adjust the length of said rod, said leg portion further including a shoe pivotally attached to a lower end portion thereof and for assisting to maintain said rod at a substantially stable position.

3. The support rod of claim 2, wherein said shoe is provided with a plurality of protrusions selectively spaced along a bottom surface thereof for adequately gripping the support surface during operating conditions.

4. An adjustable support rod for stabilizing an existing scissor jack's line of weakness wherein the jack lifts a selected vehicle end portion a short distance above ground level, said support rod comprising:

a manually operable and elongated support rod removably connectable with the jack wherein said rod is positioned along a rectilinear longitudinal axis for reinforcing the jack along the line of weakness, said rod providing an upwardly extending force that opposes operating forces exerting downwardly along the jack and being provided with axially opposed end portions wherein one said end portion contacts the jack and another said end portion is supported on ground level subjacent said jack;

wherein said rod further comprises a cylindrical body having a substantially smooth outer surface and a hollow core, said body being formed from rigid and non-corrosive material and further having opposed end portions axially aligned along a linear plane; and a pair of couplings removably positionable over said body end portions wherein one said couplings has an open top surface and another said couplings has open top and bottom surfaces respectively, said another coupling being disposed distally of said one coupling.

5. The support rod of claim 4, wherein said rod further comprises:

a leg portion removably securable to said another coupling and including an adjustable compression fitting threadably securable to said one coupling for assisting a user to adjust the length of said rod, said leg portion further including a shoe pivotally attached to a lower end portion thereof and for assisting to maintain said rod at a substantially stable position.

6. The support rod of claim 5, wherein said shoe is provided with a plurality of protrusions selectively spaced along a bottom surface thereof for adequately gripping the support surface during operating conditions.

7. An adjustable support rod for stabilizing an existing scissor jack's line of weakness wherein the jack lifts a selected vehicle end portion a short distance above ground level, said support rod comprising:

a manually operable and elongated support rod removably connectable with the jack wherein said rod is positioned along a rectilinear longitudinal axis for reinforcing the jack along the line of weakness, said rod providing an upwardly extending force that opposes operating forces exerting downwardly along the jack and being provided with axially opposed end portions wherein one said end portion contacts the jack and another said end portion is supported on ground level subjacent said jack, said opposed end portions being aligned along the line of weakness;

wherein said rod further comprises a cylindrical body having a substantially smooth outer surface and a hollow core, said body being formed from rigid and non-corrosive material and further having opposed end portions axially aligned along a linear plane; and a pair of couplings removably positionable over said body end portions wherein one said couplings has an open top surface and another said couplings has open top and bottom surfaces respectively, said another coupling being disposed distally of said one coupling.

8. The support rod of claim 7, wherein said rod further comprises:

a leg portion removably securable to said another coupling and including an adjustable compression fitting threadably securable to said one coupling for assisting a user to adjust the length of said rod, said leg portion further including a shoe pivotally attached to a lower end portion thereof and for assisting to maintain said rod at a substantially stable position.

9. The support rod of claim 8, wherein said shoe is provided with a plurality of protrusions selectively spaced along a bottom surface thereof for adequately gripping the support surface during operating conditions.

* * * * *